US006362150B1

(12) United States Patent
Lunati

(10) Patent No.: US 6,362,150 B1
(45) Date of Patent: Mar. 26, 2002

(54) DETERGENT COMPOSITION IN THE FORM OF A SOLID DETERGENT CONTAINING SURFACTANT AND BLEACHING PEROXIDE

(75) Inventor: Judas Omar Riera Lunati, Comayaguela (HN)

(73) Assignee: Corporation Cressida, Honduras ( * ) Notice: Subject to any disclaimer, the term of this patent is extended or adjusted under 35 U.S.C. 154(b) by 0 days.

(21) Appl. No.: 09/189,949

(22) Filed: Nov. 12, 1998

(51) Int. Cl.[7] ..... C11D 3/00; C11D 17/00
(52) U.S. Cl. ..... 510/309; 510/447
(58) Field of Search ..... 510/150, 441, 510/445, 446, 447, 309

(56) References Cited

U.S. PATENT DOCUMENTS

| | | | | | |
|---|---|---|---|---|---|
| 2,838,459 | A | | 6/1958 | Sprout, Jr. | 252/186 |
| 2,875,155 | A | * | 2/1959 | Miles | 252/138 |
| 3,192,255 | A | | 6/1965 | Cann | 260/502 |
| 3,198,740 | A | * | 8/1965 | Dunlop et al. | 252/90 |
| 3,442,937 | A | | 5/1969 | Sennewald et al. | 260/502 |
| 4,299,716 | A | | 11/1981 | Cottrell et al. | 252/99 |
| 4,318,818 | A | | 3/1982 | Letton et al. | 252/174.12 |
| RE32,818 | E | * | 1/1989 | Fernholz et al. | 252/90 |
| 5,225,102 | A | | 7/1993 | Coyne et al. | 252/186.26 |
| 5,234,617 | A | | 8/1993 | Hunter et al. | 252/102 |
| 5,559,089 | A | | 9/1996 | Hartman et al. | 510/224 |
| 5,759,976 | A | * | 6/1998 | Roach et al. | 510/218 |
| 5,759,988 | A | * | 6/1998 | Heile et al. | 510/441 |
| 5,795,854 | A | * | 8/1998 | Angell et al. | 510/312 |
| 5,830,839 | A | * | 11/1998 | Scepanski et al. | 510/305 |
| 5,854,189 | A | * | 12/1998 | Kruse et al. | 510/224 |

* cited by examiner

*Primary Examiner*—Yogendra Gupta
*Assistant Examiner*—John M Petruncio
(74) *Attorney, Agent, or Firm*—Fish & Richardson P.C.

(57) ABSTRACT

This invention concerns a detergent composition in solid form containing surfactant and a peroxide bleaching agent. In another preferred composition, encapsulated or non-encapsulated enzymes may be present, improving performance during washing. Other conventional additives may also optionally be present. The composition is suitable for hand washing and soaking of clothing. The process for the form relation of this composition is furthermore fundamental in order to ensure the stability of the peroxide bleaching agent and the enzyme. For this reason, low moisture materials and hydrating salts are used.

15 Claims, 4 Drawing Sheets

DETERGENT COMPOSITION IN THE FORM OF A SOLID DETERGENT CONTAINING SURFACTANT AND BLEACHING PEROXIDE

BACKGROUND OF THE INVENTION

Procter & Gamble's U.S. Pat. No. 5,234,617 mentions the use of enzymes as a desirable component in liquid compositions combined with peroxyacids. The use of enzymes is also mentioned as an optional component of sequestrants in order to prevent the loss of available oxygen, since they sequester heavy metal ions, such as magnesium, calcium, aluminum, etc.

Procter & Gamble's U.S. Pat. No. 5,559,089 mentions the use of a peroxide bleaching agent and indicates its compatibility with various types of enzymes, applied in powder form for the automatic washing of dishes. The sequestrant agents are described in various patents, including U.S. Pat. No. 3,442,937 of Sennewald, U.S. Pat. No. 2,838,459 of Sprout, Jr. and U.S. Pat. No. 3,192,255 of Carn. In addition, the use of a peroxide bleaching agent is mentioned in U.S. Pat. No. 4,299,716 of Lever Brothers Company.

The peroxyacids used in the above-mentioned patents include 4-nonylamine-4-oxoperoxybutyric acid, heptylsulfonylperpropionic acid, decyl-sulfonylperbutyric acid and others. However, the enzymes that are optionally combined with sequestrants have not previously been considered as perborate stabilizers in their various forms of hydration. Thus, although other patents mention the use of chelates, these are used as enzyme stabilizers, such as in U.S. Pat. No. 4,318,818 of Procter & Gamble.

The latest research of enzyme-producing companies indicates that their encapsulated enzymes notably increase the washing efficiency of those cleaning products that contain peroxide bleaching agents in their formula.

The Clorox Company's U.S. Pat. No. 5,255,102 indicates that once covered or encapsulated, enzymes do not undergo any kind of denaturalization in powder compositions containing oxidant bleaching agents, such as peroxyacids.

Nevertheless, it is not until now, as a result of several tests and experiments that we have conducted, that a detergent composition in solid form and containing surfactant, a peroxide bleaching agent and enzymes has been developed. Its process is also innovative and has been shown to reduce deactivation and maintain the stability of the peroxide bleaching agent and enzyme in the composition's solid matrix.

SUMMARY OF THE INVENTION

The invention describes a detergent composition in solid form containing surfactant and a peroxide bleaching agent. In another preferred composition, encapsulated or non-encapsulated enzymes may be present, improving the washing performance of the product. Because the solid matrix of the composition reaches a free environmental humidity equal to or less than 6%, excellent cleaning results were obtained from the sodium perborate monohydrate, without bleaching agent activators, and from the enzyme, under hand washing conditions using water at temperatures under 55 degrees Centigrade. Other conventional additives, such as sequestrants, systems for strengthening detergency, some alkaline salts, skin conditioners, perfumes, coloring agents, fillers, anti-redeposition agents, fabric softeners, etc., may be optionally present.

The composition is suitable for hand washing and soaking of clothes. The process for the formulation of this composition is also fundamental in order to attain the stability of the peroxide bleaching agents and the enzyme. For this reason, hydrating salts and materials with low moisture levels are used.

DETAILS OF THE INVENTION

Figure 1:
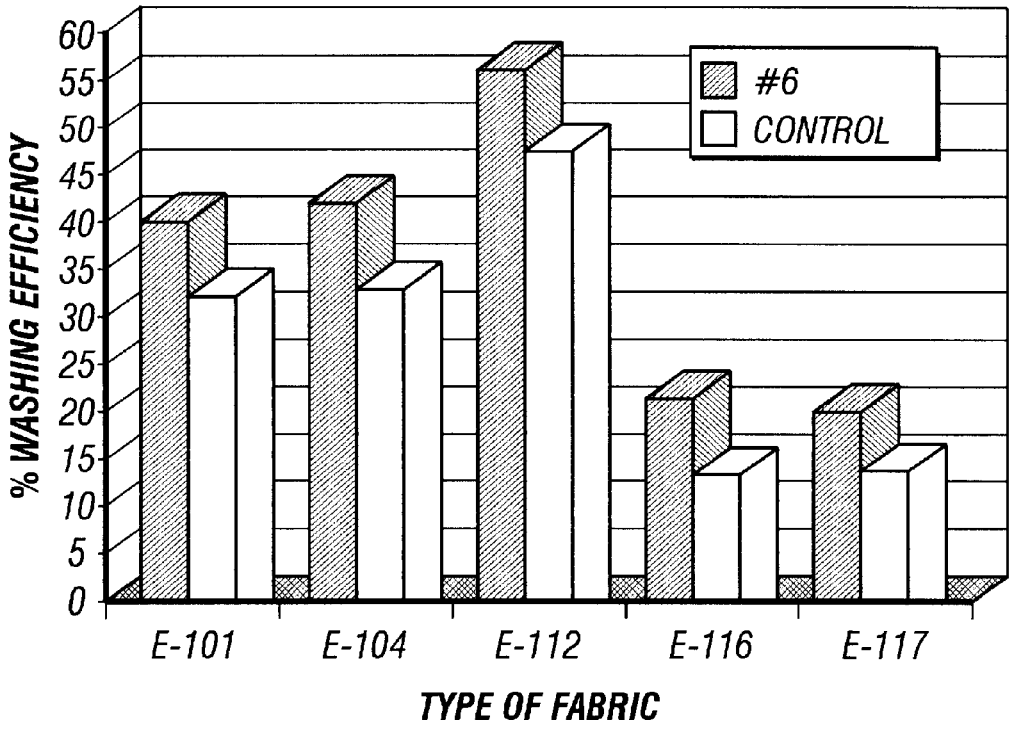
FIG. 1 is a graph of the percent washing efficiency of the compositions of Test Number 6 and the Control for the specified fabrics.

In many parts of the world, hand washing of clothes, in which the cleaning products are applied directly onto the fabric, continues to be the preferred method. This is especially true in underdeveloped countries where the income per capita of the majority of the population does not permit the purchase of automatic washing machines. The products used most often for this type of application have a solid composition. Traditional soaps derived from animal and/or vegetable fats, usually referred to as "hard soaps", are most commonly used for this purpose.

Other solid compositions that are commonly used for hand-washing clothes are synthetic detergent bars. These bars are generally considered better because of their great tolerance of hard water, making them more effective under these conditions than conventional soaps.

In general, the ability of these solid compositions to remove stains has been very poor. For example, dirty clothing tends to contain considerable amounts of proteinaceous material that can be difficult to eliminate, and that can also make other stain components adhere more firmly to the fibers of the fabric. There are special ingredients that are commonly used in the industry to improve the cleaning capacity of products for the washing of clothes, such as peroxide whiteners and enzymes. Bleachable stains such as those of tea, coffee, red wine, grape juice, etc. can be effectively eliminated through whitening with the incorporation of peroxide bleaching agents.

Protein stains, starch stains, and vegetable and animal fat stains can be efficiently removed with the application of enzymes. Proteolytic enzymes hydrolyze protein stains from grass, blood, mucous, feces and several food products, rendering them easily water soluble. Enzymes derived from amylase eliminate starchy food residue from such products as potatoes, spaghetti and chocolate. Lipase enzymes facilitate the elimination of fat stains by hydrolyzing the triglycerides into monoglycerides and diglycerides, glycerol and free fatty acids, that are more soluble than the original fats. These fats can come from, for example, food (frying fat, salad oils, butter, sauces and greasy soups), human oils and certain cosmetic products.

Nevertheless, until now, the application of peroxide bleaching agents and enzymes has been used mainly for powder detergents. This is due to the fact that for many years the paradigm has existed that bleaching agents and enzymes could not be incorporated into the matrix of a solid detergent bar due to the high levels of free humidity and temperature involved in the process. Both conditions are detrimental to the stability and the deactivation of these ingredients, such as for example, sodium perborate monohydrate. A detergent bar may contain from 6 to 10% free humidity that can remain mobile in the solid phase of the bar.

As a result of several tests and experiments that we have conducted, we have developed a detergent composition in solid form containing surfactant, a peroxide bleaching agent and enzymes. We have also developed a process that has been proven to reduce deactivation and maintain the stability of the peroxide bleaching agents and the enzyme in the solid matrix of the composition.

In addition, peroxide bleaching agents, such as sodium perborate monohydrate, reduce their activity upon contact with heavy metal ions. These ions may come from the same raw materials used in the process, and are present in the wash water. The incorporation of the sequestrant early in the process has proven effective in sequestering these ions and thus preventing the deactivation of the sodium perborate monohydrate.

COMPONENTS OF THE DETERGENT BAR DESCRIBED IN THE PATENT

1. Bleaching Agents

One of the most common bleaching or whitening agent is hydrogen peroxide, but sodium hypochloride, sodium peroxide, sodium chloride, hypochloric acid, calcium hypochloride and many other organic chloride compounds are also included in this group. The releasing compounds of hydrogen peroxide, for example, different types of perborate, and specifically, sodium perborate monohydrate, are considered to be included in this description.

The structure of these bleaching agents generally includes bivalent oxygen groups (O—O); the oxygen atoms are univalent. This structure permits the spontaneous release of atomic oxygen. Therefore, the bleaching agents are strong oxidant agents, and there is a danger of fire in the event of contact with combustible materials, especially under high temperature conditions.

Sodium perborate monohydrate is preferred as a light bleaching agent that is nevertheless effective in washing fabric. When used adequately, sodium perborate monohydrate maintains the original whiteness and brilliance of the fabrics without causing tension or rigidity by increasing and assisting the detergency of the washing formula. Thus, it improves the removal of stains and does not cause soap precipitation, and is very compatible with synthetic detergents and natural soaps. Basically, this compound has some of the qualities of hydrogen peroxide. In addition, other characteristics of this compound have been taken into consideration, such as its:

a) rapid dissolution in water
b) oxidant power
c) moderate alkalinity
d) lack of odor (it can even eliminate certain disagreeable odors)
e) compatibility with many other chemical compounds
f) good stability during storage, provided that dry conditions are maintained, even at high temperatures 2. Enzymes Basically, enzymes are a unique class of proteins that catalyze a large range of biochemical reactions. Enzymes are formed within living cells. An important characteristic is their specificity; each enzyme catalyzes one particular reaction. Among the enzymes that are frequently used in the soap and detergent industry are:

Amylase: hydrolyzes starches, facilitating their removal from fabrics.

Cellulase: simultaneously incorporates properties of softening, color intensification and the elimination of lint that makes colors opaque and makes fabrics appear older, and can also brighten cotton fabric and white and colored cotton blends that have acquired a grayish aspect.

Lipase: hydrolyzes fats.

Protease: hydrolyzes proteins in stains, forming peptides that are dissolved or disperse easily in the washing liquid; they are proteolytic enzymes produced by means of the submerged fermentation of a particular microorganism.

Currently, detergents combine two, three or four of these types of enzymes, each one of them with stabilization methods in order to prevent their degradation during storage. Current micro-encapsulation methods that have been developed enable the physical separation of the various types of individually encapsulated enzymes, since it is known that protease degrades proteinaceous material and the protein itself when in an environment that permits them to come into direct contact with each other.

The enzymes can be prepared by covering or encapsulating them with materials that are resistant to degradation in products that have bleaching agents and that permit solubility when introduced into aqueous mediums. These protecting agents may be sodium silicate and sodium carbonate: both function by physically preventing oxidants from attacking the enzymes. The protecting agents also contain reducing agents, such as sodium sulfite.

3. Sequestrants

This ingredient prevents the loss of available oxygen from the peroxide, since it sequesters heavy interfering metal ions such as magnesium, aluminum, calcium, etc. They include: polyphosphates, for example the acidic salt of pyrophosphate, sodium tripolyphosphate and tetrasodium pyrophosphate; dipicolynic acid (2,6-pyrodynic dicarboxylate acid), picolynic acid, 8-hydroxyquinoline; carboxylates, such as ethyl diamino tetraceptic acid and pentaceptic triamino diethyl acid; preferably phosphonates, such as ethylhydroxydiphosphonate, registered brand Dequest 2010, in several versions, of Monsanto, and the Briquest brand of Albright & Wilson, as well as combinations of the above.

Phosphonates belong to a family of organic phosphorous compounds that include a series of properties, including the sequestering and inhibition of incrustation and corrosion. In general, they combine the advantages of polyphosphates with those of aminocarboxylate sequestrant agents, but are more stable hydrolytically than each one of them separately.

The structure of the phosphonates is different from the structures of the polyphosphates, mainly due to the existence of a phosphorous-carbon link, instead of a phosphorous-oxygen-phosphorous link. Their superior stability under extreme temperature conditions and pH levels is due to this structural difference. The main advantages of using organic phosphonates can be summarized as follows:

a) The sequestering action of many multivalent metal ions eliminates the undesirable effects of precipitation and decomposition of whitening solutions. The most important ions for our invention are: calcium, iron, manganese, copper, magnesium and zinc. The sequestering of these ions generally requires one molecule of phosphonate for each metal ion.

b) The inhibition of incrustation/precipitation, such as iron oxide and carbonates, sulfates, and calcium silicates.

c) Hydrolytic stability which implies a high resistance to hydrolysis under various temperature and pH ranges.

d) Stabilizers in whitening systems, especially when alkaline hydrogen peroxide or its releasing compounds are used. In the absence of the contamination of metallic ions, the peroxide compounds would be sufficiently stable, even at temperatures just below their boiling point. Nevertheless, the presence of a small quantity of certain transition metals (iron, manganese, calcium) and other heavy metals (calcium, magnesium, etc.) can cause a rapid loss of available oxygen. Phosphonates reduce the decomposition of the peroxide, since they trap any heavy metal ion that might interfere.

4. Organic Detergent

These can be: anionic, non-ionic, amphoteric or cationic detergents. Detailed descriptions of these compounds can be found in just about any literature regarding this topic. The following are included as examples of active detergents that can be used in compositions of detergent bars:

a) Anionic Detergents:

Sodium salts of benzene alkyl sulfonate, from 12 to 15 atoms of carbon, such as in the products of: Vista Chemical with its registered brand C-560, Norfox with its registered brand 85T, Akzo Nobel Chemicals with its registered brand Elfan WA, etc. Sodium and/or ammonium lauryl sulfates can also be used, such as in Texapon, the K-12 registered brand of Henkel, Stepanol AM of Stepan Company, and Hortenol SLS-30 of Hart Products Corp. Also included in this group are aryl alkyl sulfonates from 10 to 18 carbon atoms, for example Witconate C-50H and Udet 950 of Witco Corp.; sodium cocoa isothyonate, such as in Tauranol I-78C of Finetex, Inc.; sodium salts of ethoxysulfanate solutions, such as Neodol 25-3S of Shell Chemical Company; sodium lauroyl sarcosinates, for example Hamposyl L. of Hampshire Chemical Corp; sodium lauryl ether sulfates, for example Standapol ES-350 of Henkel; and others such as the methyl esthers of oils and animal or vegetable fats.

b) Non-ionic Detergents

Polyoxyalkylenic alcohol derivatives, alkylamides and alkanolamides, polyoxyalkylinesthers of acids, block polymers of alkaline oxide (example: Pluronics), polyesters and acylalkalamides, as well as certain ammoniac oxides, such as Aromox DMMCD-W of Akzo Nobel Chemicals; linear ethoxylate solutions, such as Neodol 25-3 of Shell Chemical Co. and Surfonic L12-B of Huntsman Corp; ammoniac diethanol laurylamide, such as the products under the trade name of Ninol from Stepan Chemicals; mixtures of fatty solutions of polyglycol esthers with additional fatty acids, such as Dehydol HD-FC4 of Henkel; and other non-ionic detergents such as alkyl polyglucosides, including Glucopon AV-110 and 600 of Henkel.

c) Amphoteric Detergents

Betainic compounds, for example: cocoa alkylamidebetaines, such as Amido Betaine C of Zohar Detergent Factory, cocoamidopropyl betaines, such as Mirataine BET W of Rhone-Poulenc, Foamtaine CAB-A of Alzo Inc. and Lexaine C of Inolex Chemical Co.; cocoa betaines, such as Emcol CC 37-18 of Witco Corp; N-Sodium Cocobetaaminopropionate, such as Deriphat, a trademark of C M (acid in anhydride form, 1-carboxymethyl-1-carboxyethyl-2-cocoa-imidazoline betaine) and an insoluble water salt. Also included in this group are the sodium salts of compounds derived from dicarboxylic cocoa imidazoline, such as Miranol 2CIB of Rhone-Poulenc; sodium lauryl iminodipropionate, such as Monateric 1188M of Mona Industries; aminic lauryl dymethyl oxide, such as Laurelox 12 of Reilly-Whiteman Inc; and other known amphoteric detergents.

d) Cationic Detergents

Generally, high di-alkyl and low di-alkyl alkanolammonium halide compounds are used, such as ammonium chloride distearyldimethyl and 2-heptadecyl 1-methyl-1-(2-stearo amide) methyl sulfate ethylimidazoline. The high alkyls can range from between 8 and 20 atoms of carbon, preferably between 12 and 18, and the low alkyls range from between 1 and 4 carbon atoms, preferably between 1 and 2. Other quaternary ammonia compounds that may be considered include Arquad DM1413-90 of Akzo Nobel Chemical and Foamquat CAS of Alzo, Inc., the latter being an ethyldiammonia cocoamidepropyl ethasulfate. Also included in the cationic detergent group is aminic stearyl oxide, under the commercial name Hartofoam SAO of Hart Products Corp.

Normally, anionic detergents are preferred, but the other types of detergents can be used in small proportions for the creation of the detergent bar.

5. Reinforcing Agents and Detergency Catalysts

These are widely known in the art and the following are listed as examples only:

a) Hydrosoluble phosphate salts, for example tripolyphosphate, pyrophosphate and sodium orthophosphate.

b) Alkaline salts, such as: hydrosoluble carbonates, for example: sodium carbonate, sodium bicarbonate and others, such as magnesium sulfates, magnesium hydroxide, etc.

c) Organic reinforcers, for example sodium nitriloacetate, sodium ethylene diaminotetraacetate, sodium citrate, sodium tartrate, trisodium carboxymethyloxysuccinate, sodium hydrofurantetracarboxylate, sodium oxydiacetate, sodium oxydisuccinate, long chain fatty acids (C14 to C20) and sodium sulfanates.

d) Alkylamides such as lauryl monoethanolamide, isopropenolamide and others, that improve the stability of the foam and also help to increase detergency and act as skin emollients. Examples of these compounds are: Fenopen AC78 of GAF, Emid 6500 of Emery, Cyclomide C-212 of Alcolac, Carsamide CMEA of Lonza and Calamide C of Pilot, among others.

4. Other ingredients, for example, sodium alkaline silicates, polyhydric solutions, starches, bentonite, carboxymethylcellulose, coloring agents, flourescents, opaquing agents, germicides, perfumes, bleaching agents and abrasives are optionally added.

DETAILED DESCRIPTION OF THE INVENTION

This invention is a detergent in solid form, containing one, two or more active cleaning agents, bleaching agents, stabilizing compounds, reinforcing agents or detergency catalysts, alkaline salts, fillers, optical brighteners, coloring agents, perfumes and other optional ingredients that can be used for more than one of these functions. According to the invention, a composition with the following weight percentages is envisaged:

a) The peroxide bleaching agent varies between 0.5 and 20%, preferably between 1 and 10% and more preferably between 1 and 8%, in terms of the weight of the detergent bar composition.

b) Approximately 0.1 to 10% perborate stabilizing agents, preferably from 0.2 to 3.0%. If a mixture of stabilizers is used, such as sequestrant compounds with biologically active sequestrants, the principles of modem biotechnology must be taken into consideration, and specifically the usage relationship, since it is extremely important in obtaining the desired stabilizing effect. This ratio may be 2:1, preferably 1.5:1, and more preferably 1.25:1.

c) The organic surfactant component is preferably an anionic detergent, or better still, a mixture of anionic detergent and non-ionic detergent, or more preferably the combination of anionic, non-ionic and a small percentage of amphoteric detergent. The individual proportion or its mixtures vary between 10 to 50% or preferably from 20 to 30% of the bar.

d) The water used is a very important component in this invention. Water with less than 10 ppm hardness such as calcium carbonate is preferred, but normally city water can be used. The proportion is between 1 and 20%, preferably between 2 and 6%.

e) It is preferable for the detergency reinforcing agents to vary between 2 and 30%. These agents may be individual or a combination. For example, in the case of a mixture of phosphates, it is desirable for the tripolyphosphates to form a larger proportion than the pyrophosphates or other phosphates, such as sodium orthophosphate. These phosphates can be anhydride, since during the bar's manufacturing process it is necessary to hydrate the phosphate in order to form detergent crystals and abrasives, thus increasing the wash efficiency and also generating the required hardness after formation.

f) Alkaline salts are used to give the bar its alkaline character and when an acid organic detergent is used to complete its neutralization, it is preferable for the alkaline salt, for example soda ash, to be anhydride and of a high mesh, such as mesh 200 for example, and for its percentage in the bar to be around 4 to 40%, preferably from 8 to 20%.

g) The fillers and other optional materials such as alkaline silicates, polyhydric solutions, starches, bentonites, carboxymethylcellulose, coloring agents, flourescents, etc. are present in the bar in a proportion of approximately 0.01 to 10%.

METHOD OF PREPARATION

The manufacturing of the detergent composition in solid form is not very complex. Nevertheless, there are humidity and temperature parameters that must be controlled in order to prevent degradation of the sodium perborate monohydrate. The only requirement is to mix all of the components in the established order, in a stainless steel blender with helicoidal blades, preferably at 50 revolutions per minute, and then add the peroxide bleaching agent.

It is preferable to begin the preparation process by adding the alkaline salts and a percentage of the required phosphates, a vital part of the process so that the free humidity is hydrated early in the process. Next, the tensoactive agents and an additional amount of water are added in order to promote the completion of the neutralization of the surfactants that are in acid form. It is also important to add the sequestrant early so that it can trap the free metals and thus prevent degradation of the sodium perborate monohydrate. Afterwards, the soluble silicate is added, preferably at a SiO2:Na2O ratio of 2.2:1 at the larger concentration of 40%.

An alternative process is conducted when there are preneutralized surfactants. In this case, it is preferable to begin with these surfactants and then add the alkaline salts, the phosphates or a mixture of the same. Next, the alkaline silicate solution is added. The alkaline salts and the phosphates must be anhydride so that when part of the additional water is added, the solution will become hydrated, forming the detergency crystals and the desired abrasiveness in order to improve the bar's efficiency.

The process continues with the addition of the fillers followed by the optional components, adding the whitening agents, enzymes and perfume last. At the beginning of this product's development, a test blender with a 20 kg capacity was used, and those formulations that continuously provided positive results were manufactured in the plant. In order to manufacture the product described in this patent, it was necessary to overcome certain problems. These problems are detailed in the following stages:

Stage One:

The first process that was evaluated implied the addition of alkaline/neutralizing salts to the main surfactant, followed by the phosphates, sequestrants, fillers, moisturizing agent, and lastly the monohydrate perborate in order to prevent any loss of effectiveness in the action of this compound. As a chelation agent, ethylene diaminotetraceptic acid and other similar compounds were used in this stage because of their recognized and classic sequestering properties that are widely used in other types of detergents.

TABLE 1

The various tests are summarized in the following chart:

| | TEST NO. | | | | | | | | | | |
|---|---|---|---|---|---|---|---|---|---|---|---|
| PARAMETER | Control | #1 | #2 | #3 | #4 | #5 | #6 | #7 | #8 | #9 | #10 |
| % tensoactive agent | 26 | 26 | 26 | 30 | 28 | 26 | 26 | 28 | 28 | 30 | 27 |
| % alkaline salts | 12 | 14 | 22 | 18 | 22 | 10 | 10 | 18 | 14 | 14 | 14 |
| % hydrosoluble phosphates | 20 | 18 | 20 | 18 | 20 | 18 | 10 | 20 | 20 | 16 | 16 |
| % filler | CS | CS | CS | CS | CS | CS | CS | CS | CS | CS | CS |
| % monohydrate perborate | — | — | — | — | — | 2 | 1.5 | 0.8 | 2 | 2 | 2 |
| % sequestrant | — | 0.4 | 0.2 | 0.6 | 0.8 | 1 | 1 | 1.1 | 1.2 | 0.5 | 0.6 |
| % softener | 5 | 5 | 5 | 6 | 6 | 5 | 5 | 5 | 6 | 5 | 5 |

TABLE 1-continued

The various tests are summarized in the following chart:

| PARAMETER | TEST NO. Control | #1 | #2 | #3 | #4 | #5 | #6 | #7 | #8 | #9 | #10 |
|---|---|---|---|---|---|---|---|---|---|---|---|
| % anti-incrusting agent | — | — | — | — | — | — | — | — | 1 | — | — |
| % metallic silicates | — | — | — | — | — | — | 8 | — | — | 4 | 4 |
| % enzymes | — | — | — | — | — | — | — | — | — | 0.3 | — |
| Ross Miles Foam | | | | | | | | | | | |
| 50 ppm | 208/200 | 210/200 | 212/202 | 215/205 | 217/208 | 215/205 | 214/206 | 215/206 | 215/205 | 215/205 | 216/208 |
| 150 ppm | 206/200 | 215/207 | 206/296 | 217/207 | 215/205 | 217/208 | 218/205 | 210/199 | 210/200 | 220/210 | 215/205 |
| 300 ppm | 210/208 | 221/214 | 206/296 | 217/206 | 205/195 | 210/201 | 217/205 | 218/206 | 215/205 | 220/210 | 210/201 |

The optimal levels of the most important compounds (hydrosoluble phosphates, neutralizers, tensoactive agents and others) were determined by means of tests #1 to #4. Based on the satisfactory results of the foam analysis obtained in the tests conducted in the test blender, the corresponding plant tests were conducted, in which problems of a diverse nature were observed: in formulas #1, #2 and #3, the process was impeded, while test #4 went well, but later presented cracks in the finished product.

In order to improve washing efficiency, the monohydrate perborate and metallic silicates were included, once again using the test blender (tests #5 and #6), noting a vast improvement in said parameters. The results are summarized in FIG. 1:

These washing efficiency analyses, and those mentioned above, were carried out using an agitation meter with six receptors. This device reproduces the operation of a washing machine, simulating the type of agitator used in these machines. It includes a thermostatically controlled water bath that ensures a constant temperature during washing, six stainless-steel agitators powered by means of a motor, stainless-steel containers and an automatic time controller.

The detergency level of any soapy or synthetic washing material is determined by washing fabric that has been previously stained with known products and measuring the amount of soiling removed or re-deposited. This process is conducted using fabrics with standard stains and measuring the removal of soiling, determining the reflectance before and after washing.

Generally, the following washing conditions are used:

Bath temperature: 30 degrees Centigrade

Washing time: 15 minutes

Rinsing time: 5 minutes

Hardness of the washing and rinsing water: 50 ppm (calcium carbonate)

Fabric size: 2 pieces of 3"×4"/container

Concentration of the product being tested: 2 g/L

The following are the characteristics of the fabric stains being washed and used to evaluate the washing efficiency of the various tests that were conducted:

Sample 101: oily, 100% cotton

Sample 104: oily, 65% polyester/35% cotton

Sample 112: cocoa/milk/sugar, 100% cotton

Sample 116: blood/milk/ink, 100% cotton

Sample 117: blood/milk/ink, 65% polyester/35% cotton

It must be noted that tests #5 and #6 were not conducted in the plant due to the extreme hardness of the mass obtained, and for this reason the total active ingredient was once again increased to a level between 27% and 32% in test #7. This last test was conducted on a large scale and a satisfactory product was obtained, but it was not sufficient.

The formulation was improved, obtaining a better appearance by increasing the content of the softener and by adding an anti-incrusting agent in test #8. Although the final product presented the desired physical characteristics, the foam lost some stability.

Figure 2:
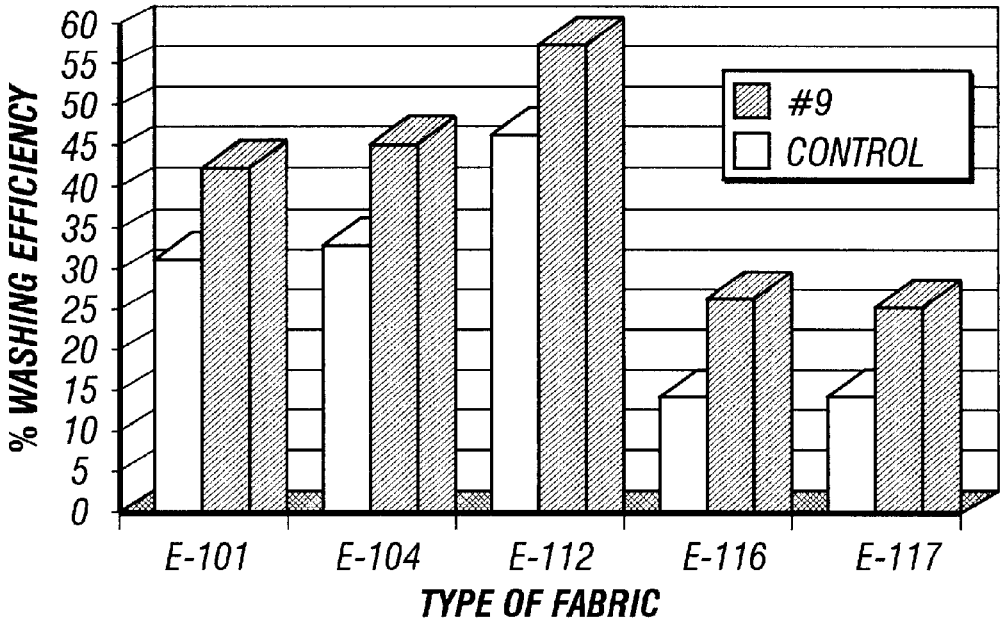
FIG. 2 is a graph of the percent washing efficiency of the compositions of Test Number 9 and the Control for the specified fabrics.
Figure 3:
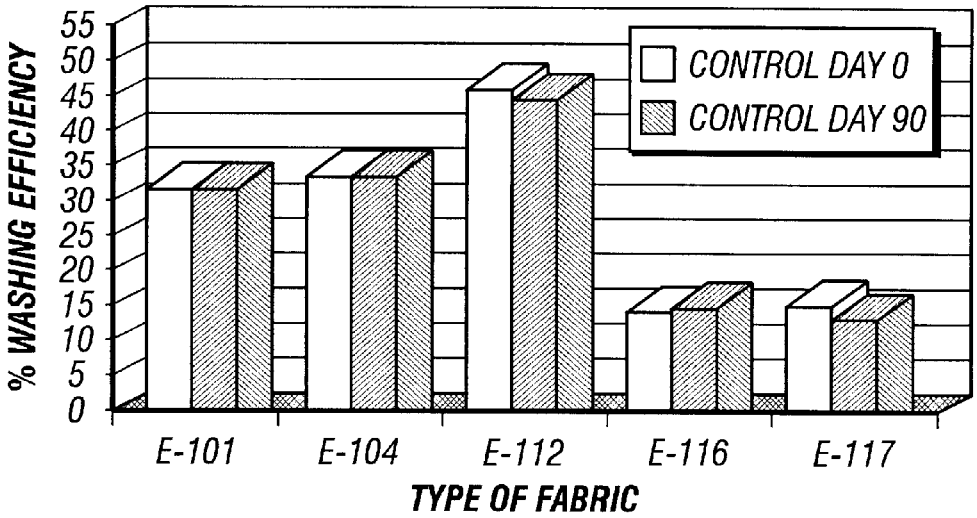
FIG. 3 is a graph of the percent washing efficiency of the Control composition after zero days and 90 days relative for the specified fabrics.
Figure 4:
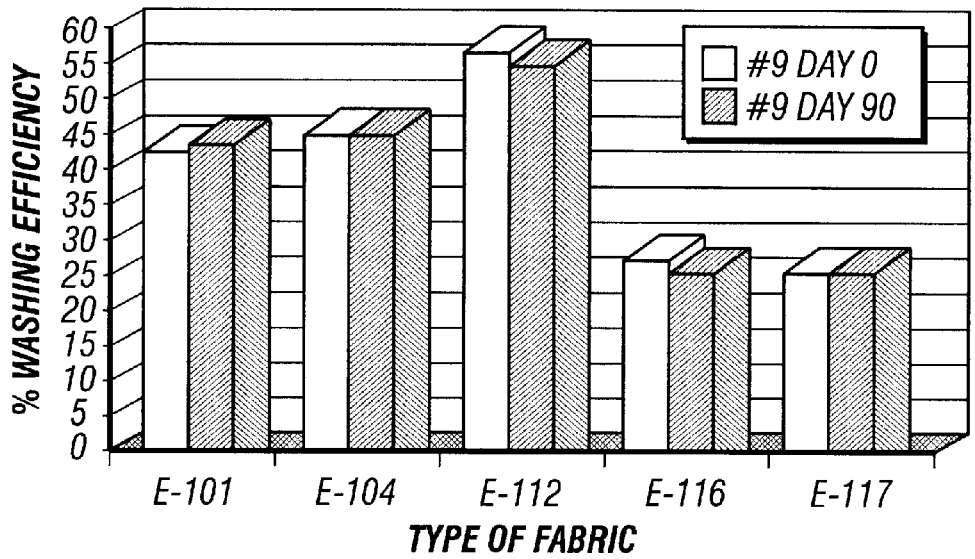
FIG. 4 is a graph of the percent washing efficiency of the composition of Test Number 9 after zero days and 90 days for the specified fabrics.

In order to restore the stability of the foam, the tensoactive content was increased and the level of hydrosoluble phosphate salts was reduced. A small quantity of enzymes was added in order to further improve the wash efficiency and the stability of the monohydrate perborate. This worked well, did not produce any cracks in the final product, but the consistency was too soft when manufactured in the plant (Test #9). Several wash efficiency charts are shown in FIGS. 2–4 that show both the stability as well as the great effectiveness of the perborate/enzyme/sequestrant mixture.

Test #10 concludes this stage, defining the percentage of surfactant at a level between 25% and 30%, a situation that permitted a favorable extrusion.

Stage Two:

In view of the properties of the sequestrants, the development of the detergent bar was continued using said compounds. The following chart summarizes the results.

TABLE 2

| PARAMETER | TEST NUMBER #11 | #12 | #13 |
|---|---|---|---|
| % tensoactive agent | 28 | 28 | 28 |
| % alkaline salts | 14 | 14 | 14 |
| % hydrosoluble phosphates | 16 | 16 | 16 |
| % filler | 17 | 17 | 17 |
| % monohydrate perborate | 2 | 2 | 2 |
| % sequestrant I | 1 | — | 0.5 |
| % sequestrant II | — | 0.5 | — |
| % softener | 5 | 5 | 5 |
| % metallic silicates | 4 | 4 | 4 |
| % enzymes | 0.3 | 0.3 | 0.3 |
| Ross Miles Foams | | | |
| 50 ppm | 215/205 | 218/211 | 215/205 |
| 150 ppm | 215/205 | 217/207 | 215/206 |
| 300 ppm | 215/203 | 218/209 | 216/208 |

Figure 5:
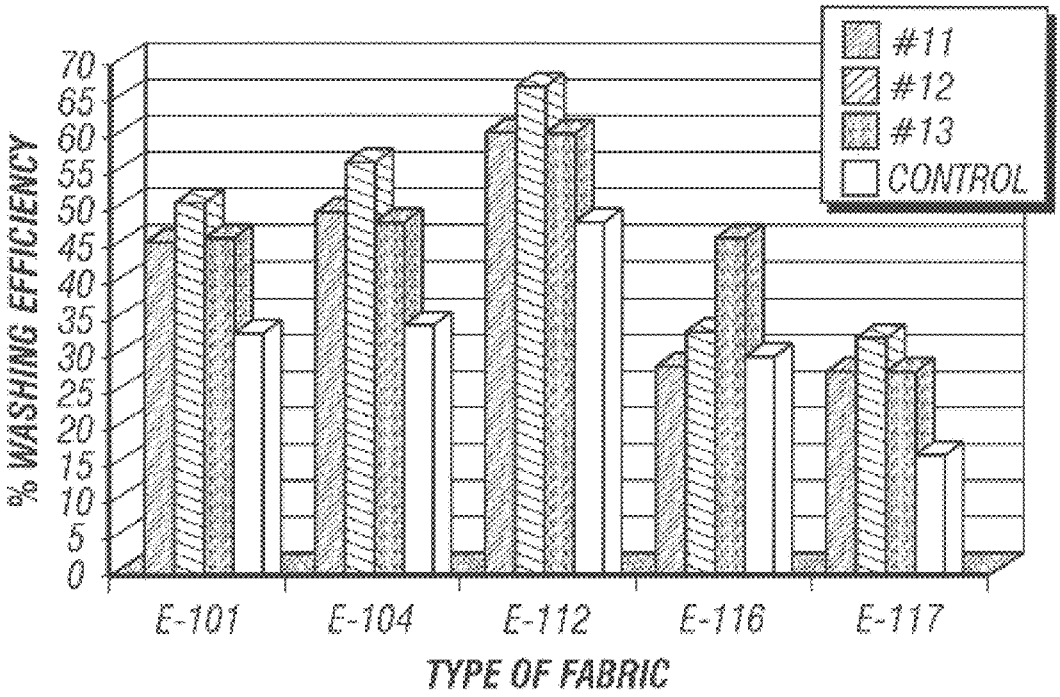
FIG. 5 is a graph of the percent washing efficiency of the compositions of Test Numbers 11–13 and the Control for the specified fabrics.

Several tests were conducted with two types of sequestrant. Using the test blender, the best results were obtained using sequestrant II, both in efficiency as well as in foam, since the other sequestrant (sequestrant I) had a liquid composition and introduced non-desired water into the system, causing great softness in the resulting mass. The efficiency graph shown in FIG. 5 indicates the results.

With regard to the in-plant tests (see chart number 3; tests #14 and #15), consistency was not satisfactory, since the first was too consistent and the second, too soft.

TABLE 3

| PARAMETER | TEST NUMBER #14 | #15 |
|---|---|---|
| % tensoactive agent | 28 | 27 |
| % alkaline salts | 14 | 14 |
| % hydrosoluble phosphates | 16 | 16 |
| % filler | 17 | 17 |
| % monohydrate perborate | 2 | 2 |
| % sequestrant II | 0.5 | 0.5 |
| % softener | 5 | 3.5 |
| % metallic silicates | 4 | 4 |
| % enzymes | 0.3 | 0.3 |
| % additional water | — | 2 |
| Ross Miles Foams | | |
| 50 ppm | 215/204 | 210/200 |
| 150 ppm | 216/205 | 215/206 |
| 300 ppm | 215/204 | 210/200 |

Stage 3

Because the surfactant's neutralization reaction is extremely exothermic, recording temperatures of up to 85 degrees Centigrade, and because the sodium perborate monohydrate decomposes at said temperatures, the process was changed in order to more effectively add this compound, with the practical purpose of reducing the temperature to less than 55 degrees Centigrade.

The process consists of the addition of the main tensoactive agent to a mixture of alkaline salts, phosphates and metallic silicates, followed by coloring agents, a small quantity of filler and sodium silicates. After adding the rest of the filler, the softener, the sequestrant or mixtures of these, the enzymatic solution, and finally the sodium perborate monohydrate and the perfume is added.

The results of this stage are summarized in table 4 below:

TABLE 4

| PARAMETER | TEST NUMBER #16 | #17 | #18 | #19 | #20 |
|---|---|---|---|---|---|
| % tensoactive agent | 27 | 27 | 28 | 28 | 27 |
| % non-ionic surfactant | — | 1 | 1 | 1 | 1 |
| % alkaline salts | 12 | 12 | 12 | 12 | 12 |
| % hydrosoluble phosphates | 14 | 14 | 14 | 14 | 14 |
| % filler | CS | CS | CS | CS | CS |
| % anti-incrusting agent | — | — | — | 1 | 1.5 |
| % monohydrate perborate | 2 | 2 | 2 | 2 | 2 |
| % sequestrant II | 0.2 | 0.2 | 0.2 | 0.2 | 0.2 |
| % softener | 5 | 5 | 5 | 5 | 5 |
| % metallic silicates | 4 | 4 | 4 | 4 | 4 |
| % enzymes | 0.3 | 0.3 | 0.3 | 0.3 | 0.3 |
| Ross Miles Foams | | | | | |
| 50 ppm | 217/206 | 218/207 | 217/206 | 218/207 | 216/205 |
| 150 ppm | 218/209 | 218/206 | 218/208 | 218/206 | 217/207 |
| 300 ppm | 216/207 | 217/207 | 218/209 | 216/205 | 215/207 |

It must be emphasized that at the beginning of this stage, a pure tensoactive agent was used. In other words, without a bleaching agent, in order to improve the consistency of the product, since this reduces the contents of the water and the hydrogen peroxide that had been added in the previous stages. In addition, a non-ionic tensoactive agent is included, producing a synergistic effect in the cationic surfactant.

Figure 6:
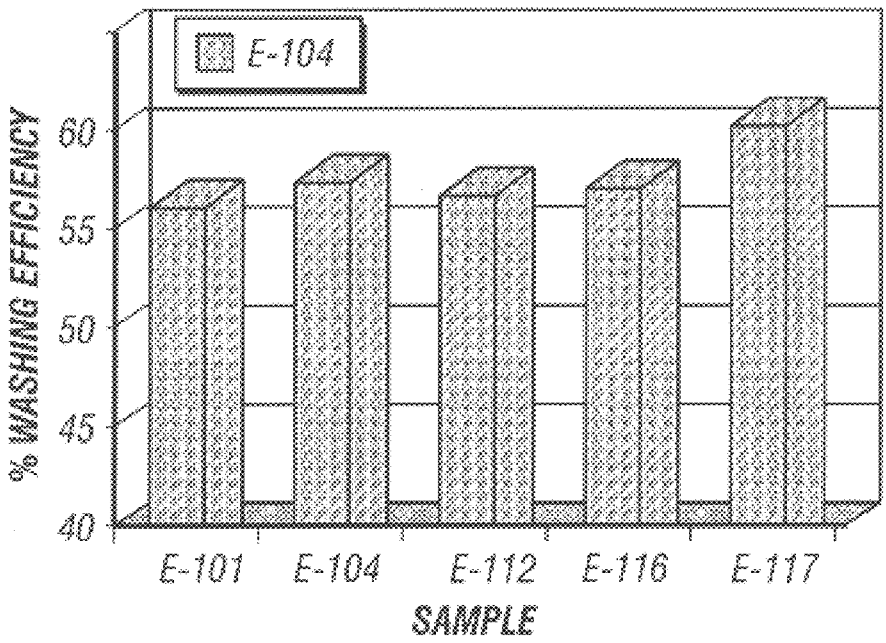
FIG. 6 is a graph of the percent washing efficiency achieved for the compositions of Test Numbers 16–20 for fabric E-104.

The wash efficiency levels of the tests that were conducted are presented schematically in FIG. 6:

Stage 4:

Continuing with the improvement of the process and the final product, the active ingredients are added after the neutralization of the main anionic surfactant. In addition, a compound widely known as a great foam "booster", an amide alkyloly, is added to the formulation, providing the mass with a plasticizing effect, giving the product a more compact appearance.

The results are summarized in this chart:

TABLE 5

| PARAMETER | TEST NUMBER #21 | #22 |
|---|---|---|
| % tensoactive agent | 27 | 27 |
| % non-ionic surfactant | 1 | 1 |
| % alkaline salts | 12 | 12 |
| % hydrosoluble phosphates | 14 | 14 |
| % filler | C.S. | C.S. |
| % sodium silicates | 0 | 2 |
| % monohydrate perborate | 2 | 22 |
| % sequestrant II | 0.5 | 0.5 |
| % softener | 4 | 4 |
| % metallic silicates | 4 | 4 |
| % enzymes | 0.3 | 0.3 |
| % alykyloamides | 2 | 2 |
| % added water | 2 | 2 |
| Ross Miles Foams | | |
| 50 ppm | 225/215 | 226/215 |
| 150 ppm | 223/212 | 224/216 |
| 300 ppm | 223/214 | 225/217 |

Figure 7:
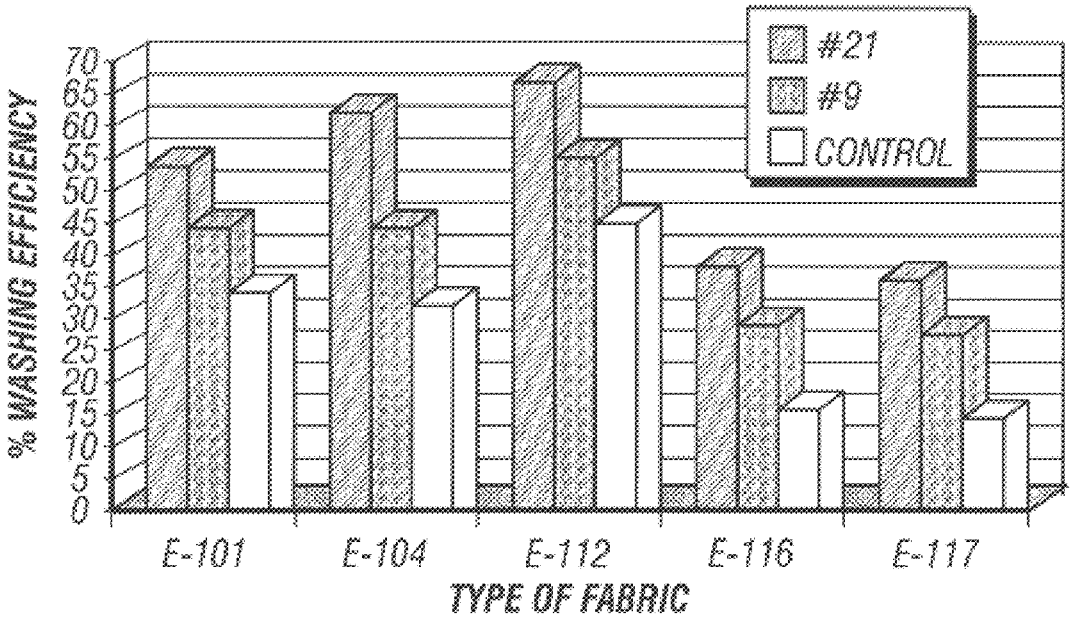
FIG. 7 is a graph of the percent washing efficiency of the compositions of Test Numbers 21 and 9 and the Control for the specified fabrics.

FIG. 7 is a graph that shows the washing efficiency obtained by means of the formulations described above:

What is claimed is:

1. A solid hand laundry detergent composition, said composition comprising:

a) from 10% to 50% by weight surfactant selected from the group consisting of anionic surfactants, cationic surfactants, non-ionic surfactants, amphoteric surfactants, and mixtures thereof;

b) from 0.5% and 20% by weight peroxide bleaching agent; and c) from 2% to 30% by weight detergency reinforcing agent; and d) from 4% to 40% by weight alkaline salts;

wherein at least one of the detergency reinforcing agent and the alkaline salts are sufficiently hydrated to provide a solid matrix with no greater than 6% by weight free humidity in the composition.

2. The solid detergent composition of claim 1, further comprising 0.015% to 3% enzymes selected from the group consisting of protease, amylase, lipase, cellulose, peroxidase, and combinations thereof.

3. The solid detergent composition of claim 1 or claim 2 further comprising 0.05% to 10.0% by weight sequesterant selected from the group consisting of polyphosphates, carboxylates, phosphonates, and combinations thereof.

4. The composition of claim 2, wherein said enzymes comprise encapsulated enzymes.

5. The composition of claim 3, wherein said polyphosphate is selected from the group consisting of sodium tripolyphoshate, tetrasodium pyrophosphate, and combinations thereof.

6. The composition of claim 3, wherein said carboxylates are selected from the group consisting of tetraacetic diamino ethylene, pentaacetic triamino diethyl acid, and combinations thereof.

7. The composition of claim 1, wherein said peroxide bleaching agent comprises sodium perborate monohydrate.

8. The composition of claim 1, further comprising metallic silicates.

9. A method of preparing a solid hand laundry detergent composition comprising combining the following components:

(a) 4% by weight to 40% by weight anhydrous alkaline salts, based on the weight of the final composition;

(b) 2% by weight to 30% by weight anhydrous detergency reinforcing agents;

(c) water;

(d) 10% by weight to 50% by weight surfactant;

(e) 0.1% by weight to 10% by weight sequestrant; and (f) 0.5% by weight to 20% by weight peroxide bleaching agent;

wherein sufficient water is added to hydrate the detergency reinforcing agents and the alkaline salts to provide a solid matrix with no greater than 6% by weight free humidity.

10. The method of claim 9, further comprising adding 0.1% by weight to 10% by weight of a filler.

11. The method of claim 9, further comprising adding an enzyme.

12. A solid hand laundry detergent composition, said composition comprising:

a) from 20% to 30% by weight, based on the final weight of the composition, of a surfactant selected from the group consisting of anionic surfactants, cationic surfactants, non-ionic surfactants, amphoteric surfactants, and mixtures thereof;

b) from 1% to 8% by weight monohydrate perborate; and c) from 2% to 30% by weight phosphate salts; and d) from 8% to 20% by weight alkaline salts;

wherein the detergency reinforcing agent and the alkaline salts are sufficiently hydrated to provide a solid matrix with no greater than 6% by weight free humidity.

13. The composition of claim 12, further comprising 0.2% to 3.0% by weight of a sequestrant.

14. The composition of claim 12, further comprising an enzyme.

15. The composition of claim 12, further comprising 0.1 to 10% of a filler.

* * * * *